United States Patent [19]

Glen

[11] Patent Number: 4,997,398

[45] Date of Patent: Mar. 5, 1991

[54] INTERNAL COMBUSTION AIR INTAKE

[75] Inventor: Robert D. Glen, Oxford, England

[73] Assignee: E. P. Barrus Limited, Bicester, England

[21] Appl. No.: 319,797

[22] Filed: Mar. 6, 1989

Related U.S. Application Data

[63] Continuation of Ser. No. 138,658, Dec. 28, 1987, abandoned, which is a continuation of Ser. No. 914,258, Oct. 7, 1986, abandoned.

[30] Foreign Application Priority Data

Oct. 2, 1985 [GB] United Kingdom ..... 8524232

[51] Int. Cl.[5] ..... B63B 43/02

[52] U.S. Cl. ..... 440/88; 440/111

[58] Field of Search ..... 440/88, 111; 441/35, 441/40, 41; 114/343, 345

[56] References Cited

U.S. PATENT DOCUMENTS

| | | | |
|---|---|---|---|
| 3,416,171 | 12/1968 | Hennebutte | 114/345 |
| 3,659,298 | 5/1972 | Edwards | 114/345 |
| 3,812,805 | 5/1974 | Forssell | 114/345 |
| 4,088,090 | 5/1978 | Brinton | 440/88 |
| 4,371,348 | 2/1983 | Blanchard | 440/88 |
| 4,568,293 | 2/1986 | Yazaki | 440/88 |

FOREIGN PATENT DOCUMENTS

| | | | |
|---|---|---|---|
| 2161772 | 1/1986 | United Kingdom | 440/88 |

*Primary Examiner*—Joseph F. Peters, Jr.
*Assistant Examiner*—Clifford T. Bartz
*Attorney, Agent, or Firm*—John N. Bain; Raymond J. Lillie

[57] ABSTRACT

An air intake installation for the carburetor system of an outboard motor is in the form of an elongate duct e.g. 9, 13*a*, so configured, located or equipped as to prevent water reaching the carburetor system even if the vessel capsizes. Preferably, a tube 9 (flexible to permit steering or tilting the motor) communicates with rigid under-deck elongate buoyancy spaces forwardly open at 14 and optionally gravity-valved at this open end to close on capsizing.

6 Claims, 1 Drawing Sheet

INTERNAL COMBUSTION AIR INTAKE

Figure 1:
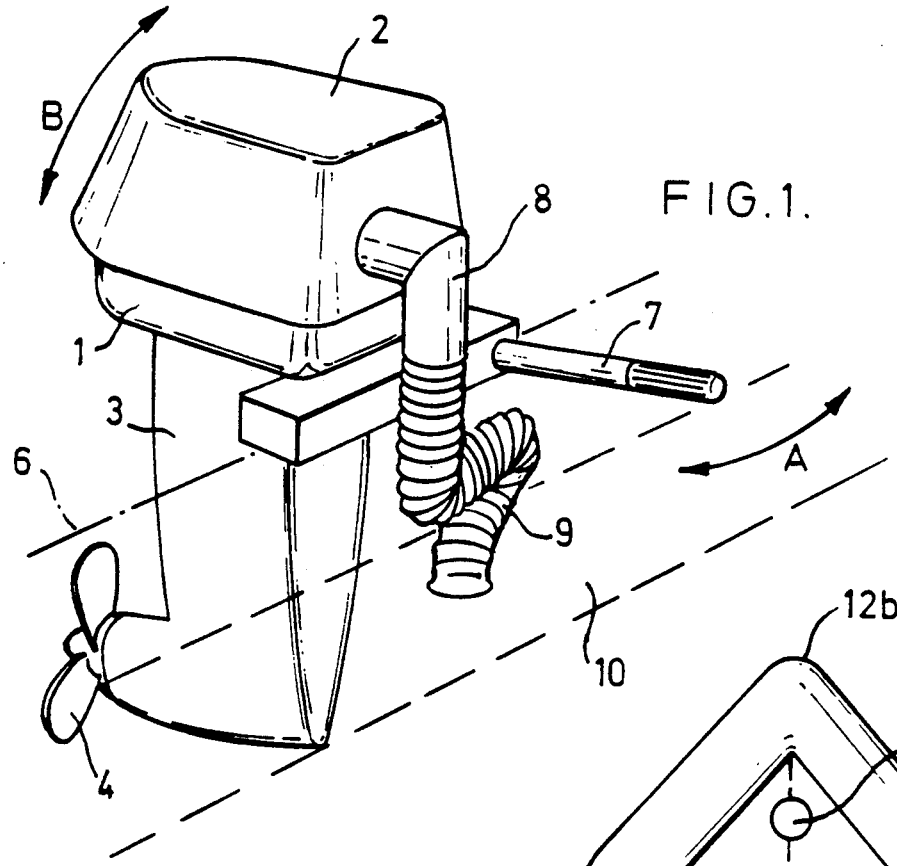

This is a continuation of Ser. No. 07/138,658, filed Dec. 28, 1987; which is a continuation of Ser. No. 06/914,258, filed Oct. 7, 1986.

This invention relates to internal combustion engines, and more particularly to the air intake of such engines when used in waterborne or similar vehicles.

An internal combustion engine for a land vehicle is normally not designed in any way for contact with, or immersion in, a body of water. Should such immersion occur as the result of an accident the engine stops, becomes flooded with water, and needs specialist attention thereafter.

In a few vehicles with an on-land or in-water capability (e.g. tanks and such military vehicles) the problem of occasional water immersion is dealt with by providing a surrounding sealed housing for the whole engine, with suitable above-water level intake and exhaust ducting, permanently in place about the engine.

Waterborne craft with outboard motors have an expectation that water will contact the engines, either as splashes or as a temporary immersion (heavy seas, or on rearward launching) or as a longer-term immersion (during a capsize or even sinking). Such vessels are used for rescue or assault purposes in adverse weather conditions, and must therefore be able to continue functioning as soon as possible after any such occurrence. Similarly, on-board engines on craft with a capsize and self-righting capability must also be able to cope with such eventualities.

In such contexts it is also known to shield the whole engine, with suitable inlet and exhaust ducting to such an engine casing, possibly valved. However, such a shielding, while economic for large high-value tank engines (for example) is not so suitable for the smaller engines encountered in rescue craft or the like, so that only the largest models or engines really lend themselves to this expedient.

It is therefore commonplace to design a marine outboard, or like motor, to be generally tolerant to at least minor contact with water and to somehow adapt the position or nature of the air intake to avoid water ingress to the carburetors and cylinders. However, even if the air intake is located and oriented to resist casual splashes, it will still permit such ingress of water on total immersion. One suggestion to overcome this has been to provide a selectively operable seal at the air inlet to the engine, but a simple reliable mechanism e.g. gravity-operated typically only works on complete inversion and even then can permit small quantities of water to pass, often enough to flood the carburetor at least.

The present invention sets out to overcome the above problems and to provide an air intake system which is adaptable for use even on relatively small outboard motors or inboard motors to prevent water access to the carburetors, and engine interior, and even in respect of capsizing or like contact with an immersing bulk of water.

The invention consists in an air intake installation for the internal combustion motor of a marine craft, which motor may be subject from time to time when in use to partial or total immersion in water: characterised in that the carburetors air intake, or a common air intake for a number of carburetors, or separate air intakes for a number of carburetors is or are formed as an elongate duct or ducts, the configuration of which ducts and/or the location of the air inlet end of which and/or the nature of the said air inlet end is such as protect the said carburetor or carburetors against ingress of water during such partial or total immersion of the motor.

In one preferred form of the invention the elongate duct or ducts comprises a flexible region between the motor housing and a further rigid chamber extending along the vessel and open at its forward end. The flexible region should be such as to permit relative movement of the motor and vessel, whereby this embodiment is particularly valuable for use with outboard motors capable of turning and swinging in relation to the vessel. The further rigid ducting can conveniently comprise a longitudinal buoyancy chamber beneath the vessel deck, as commonly encountered in the socalled "rigid inflatable boats". It will normally, in any case, be below the level of the motor in normal use and its intake end will preferably be at its highest point.

Such elongate ducting will usually although not invariably comprise a valve at the air inlet, e.g. a gravity operated valve which shuts off access of water to the duct and prevents the air inlet shipping water in significant amounts during a capsize.

The invention extends to vessels, especially assault or rescue craft of the rigid inflatable boat type, fitted with one or more motors, especially outboard motors equipped with an air intake installation as described above.

Figure 3:
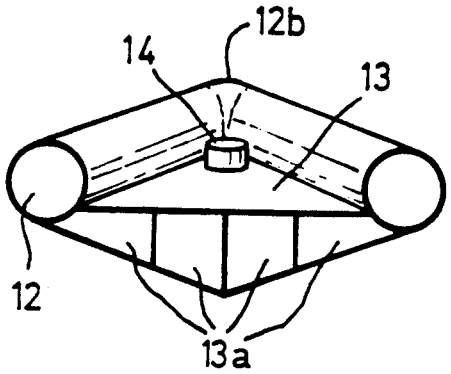
Figure 2:
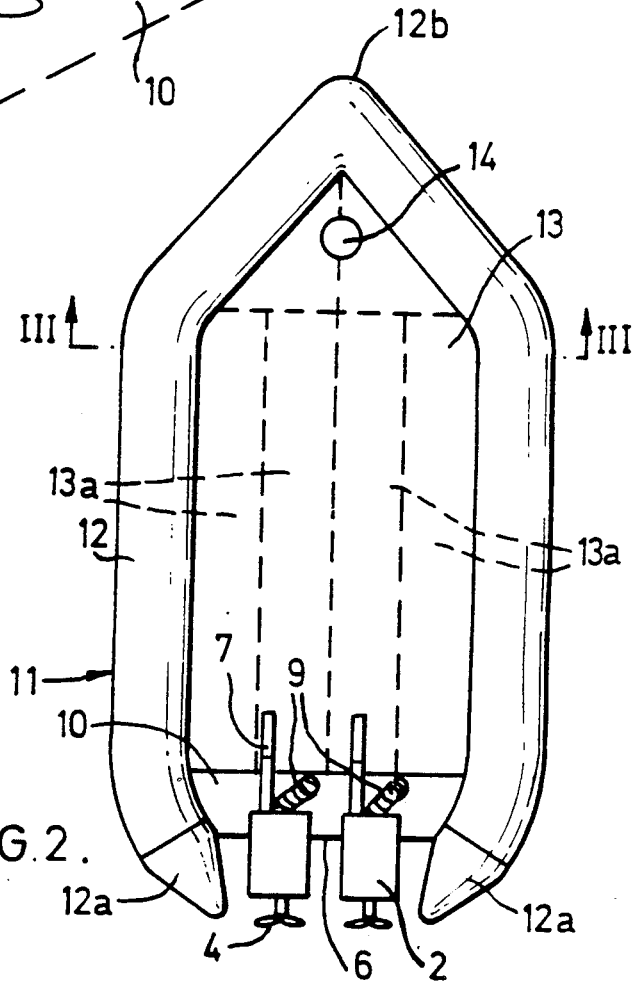

The invention will be further described with reference to the accompanying drawings, in which:

FIG. 1 shows diagrammatically the main component parts of an outboard motor as mounted at the stern of a rescue or assault craft and fitted with air inlet ducting to the carburetors in accordance with the invention, FIG. 2 shows diagrammatically from above the positioning of two such motors in relation to the components of a "rigid inflatable boat", and FIG. 3 shows diagrammatically a section along III—III of FIG. 2.

In FIG. 1 there is shown in full lines the general structure and location of an installed and operating outboard motor. Typically, in such a motor the engine (not shown) is supported on tray 1 and covered by lid 2, which is accommodated on the tray as a simple latched fitting around its periphery. Beneath the tray is a rudder 3 housing the drive connection to propeller 4 at the lower end of the rudder. The motor is arranged on a mounting 5 at the stern (shown at chain-dotted line 6) of a suitable rescue, assault or pleasure craft and has a tiller 7 projecting into the craft, or remote steering. Mounting 5 is such that (a) the tiller can be swung over arc A, to turn the whole motor, and hence rudder 3, for steering the craft (or can be remotely steered with or without the tiller) and (b) the motor can be tilted up so that the rudder and propeller move in the direction of arrow B to come out of the water or to lie in a convenient position for launching.

The above features are generally conventional and common to a wide range of outboard motor designs. In accordance with the present invention, however, the air supply to the carburetors is unified to a single entry port which is externally fitted to (in the example shown) rigid angle ducting 8 itself connected to flexible ducting 9 to a suitable opening in the rearward part of the deck 10 to communicate with the underdeck buoyancy spaces.

FIGS. 2 and 3 show a typical practical arrangement, also diagrammatically. Two separate motors are often used, to give extra power when needed, or a redundancy of power supply in case of breakdown. (The tillers can be yoked to a single system as described in our earlier Patent). Two separate lengths 9 of the flexible tubing thus pass into the deck at 10. A vessel 11 of the "rigid inflatable boat" type comprises a surrounding heavyduty buoyancy tube 12 fixed securely around the upper edge of a vessel hull, with rearward ends 12*a* extending to protect and shield the motor installation and a forward end 12*b* generally angled in a bows configuration. The deck 13 of the vessel covers and defines separate longitudinal rigid buoyancy chamber 13*a* with which the flexible tubing 9 communicates. These chambers have (as is already conventional) a common air inlet fitted with a gravity valve 14, e.g. of a type in which a heavy ball closes a flap valve.

The effective air inlet (from ambient air) to the carburetors is thus at valved air inlet 14.

When the craft is loaded, and especially when it is moving forward, the bows 12*b* are uppermost. Valved air inlet 14 is thus at a location as free as possible from casual water splashes. Also, the total air ducting configuration extends from a higher inlet, along the vessel to a low point near the stern, and then upward again to the motor. Even if some water enters at 14, it will tend to lie thereafter within ducting 13*a*, towards the stern, and not enter the carburetors.

When, on the other hand, the craft is capsized, the inlet 14, which is within a structure lower than the tube 12*a* diameter, is located within an effective air pocket at the bows, which are again the highest point. Also, the gravity valve is closed. No significant amount of water, beyond that which can acceptably accumulate in ducting 13*a* when the vessel is righted, will enter. The embodiments as shown in FIGS. 1, 2 and 3 are only by way of example of the present invention. Provided that there is more or less elongate ducting communcating with the carburetor intake and that the configuration of the ducting and/or the location of the air inlet to the ducting and/or the nature of such air inlet is such as to, protect the carburetor against flooding by water, various modifications may be made in the embodiment shown.

For example in the embodiment shown the effective ducting includes the buoyancy spaces under the deck of the vessel. However, if desired, separate ducting extending along the vessel, could be supplied. It need not extend as for forward as the example shown, although generally if the ducting is shorter there is a greater need for an effective closure valve.

The connection between the motor and the duct can be flexible, as shown, or rigid, especially of a floor-mounted fixed-position inboard engine is present. The particular shape of the composite rigid flexible structure shown, using rigid angled connector ducting 8, has been found in practice to accommodate the particular turning (arrow A) and swinging motions (arrow B) required for the type of motor shown in the drawings.

The air inlet 14 is shown as valved. This is generally preferable, but with enough length of duct, of suitable shape, an unvalved inlet 14 may be permissible.

Two motors are shown in FIG. 2. This is a preferred arrangement. Totally separate ducting (as shown) is preferable for such arrangements, but a single ducted air supply to a cross-connector i.e. an effective T-junction is also within the scope of the invention.

The invention as described above possesses the advantages of providing an effective barrier to water while costing less than prior art arrangements.

I claim:

1. Air intake means for protecting a carburetor of an internal combustion motor of a marine craft against flooding by water during immersion of the motor, comprising: a first ducting portion extending along a major portion of the length of the marine craft and having a first end located in the forward end of the craft for receiving air located remote from said motor and a second end; and a second ducting portion for connecting said first ducting portion to a carburetor air inlet opening on said motor, said carburetor air inlet opening being located at a higher level than the second end of the first ducting portion, whereby the configuration of said first ducting portion and the location of the first end enables the carburetor to be protected against flooding.

2. An air intake installation as claimed in claim 1, in which said first ducting portion is provided at the first end with a valve to protect against water ingress.

3. An air intake installation as claimed in claim 2, in which the valve is gravity operated to close said first end if the vessel capsizes.

4. An air intake installation as claimed in claim 1, in which said first ducting portion comprises at least in part a longitudinal buoyancy chamber beneath a deck of said marine craft.

5. A marine craft comprising:

(a) at least one internal combustion motor having a carburetor and an air inlet opening for said carburetor; and (b) an air intake means itself comprising (i) a first ducting portion having a first end and a further end, said first ducting portion extending along a major portion of the said marine craft, said first end being disposed in the forward end of the craft remote from said motor and (ii) a second ducting portion for connecting the further end of said first ducting portion to said air inlet opening, said air inlet opening being located at a higher level than the further end of said first ducting portion, whereby the configuration of the first ducting portion and the location of the first end enables the carburetor to be protected against flooding by water during immersion of the motor.

6. A marine craft as claimed in claim 5, wherein said marine craft comprises a rigid inflatable boat comprising at least part of said first ducting portion disposed beneath a deck thereof.

* * * * *